US011511298B2

(12) United States Patent
Hawley et al.

(10) Patent No.: US 11,511,298 B2
(45) Date of Patent: Nov. 29, 2022

(54) CORROSION PROTECTION FOR PLASMA GUN NOZZLES AND METHOD OF PROTECTING GUN NOZZLES

(71) Applicant: OERLIKON METCO (US) INC., Westbury, NY (US)

(72) Inventors: Dave Hawley, Westbury, NY (US); Ronald J. Molz, Westbury, NY (US); Jose Colmenares, Westbury, NY (US)

(73) Assignee: OERLIKON METCO (US) INC., Westbury, NY (US)

( * ) Notice: Subject to any disclaimer, the term of this patent is extended or adjusted under 35 U.S.C. 154(b) by 0 days.

(21) Appl. No.: 14/568,833

(22) Filed: Dec. 12, 2014

(65) Prior Publication Data

US 2016/0167063 A1 Jun. 16, 2016

(51) Int. Cl.

| | |
|---|---|
| ***B05B 7/22*** | (2006.01) |
| ***C23C 4/134*** | (2016.01) |
| ***B05B 15/18*** | (2018.01) |

(52) U.S. Cl.

CPC ..... *B05B 7/222* (2013.01); *B05B 15/18* (2018.02); *C23C 4/134* (2016.01)

(58) Field of Classification Search

CPC ..... B05B 1/24; B05B 7/222; B05B 15/18; C23C 4/134

USPC ..... 239/128

See application file for complete search history.

(56) References Cited

U.S. PATENT DOCUMENTS

| | | | | | |
|---|---|---|---|---|---|
| 4,235,943 | A | | 11/1980 | McComas et al. | |
| 4,358,053 | A | * | 11/1982 | Ingham | B05B 7/205 239/132.3 |
| 4,634,611 | A | * | 1/1987 | Browning | C23C 4/129 239/132.3 |
| 5,008,085 | A | * | 4/1991 | Bain | C10G 9/007 166/59 |
| 5,014,901 | A | * | 5/1991 | Moran | B23K 9/046 228/119 |
| 5,135,166 | A | * | 8/1992 | Dietiker | B05B 7/205 239/13 |
| 5,285,967 | A | * | 2/1994 | Weidman | B05B 7/205 239/80 |

(Continued)

FOREIGN PATENT DOCUMENTS

| | | |
|---|---|---|
| EP | 0 194 634 | 9/1986 |
| JP | 58-73366 | 5/1983 |

(Continued)

OTHER PUBLICATIONS

International Search Report in counterpart Int'l. Appln. No. PCT/US2015/064465 (dated Feb. 16, 2016).

(Continued)

*Primary Examiner* — Qingzhang Zhou

(74) *Attorney, Agent, or Firm* — Greenblum & Bernstein, P.L.C.

(57) ABSTRACT

Nozzle for thermal spray gun, thermal spray gun and method for forming nozzle. Nozzle includes a nozzle body having a central bore and an exterior surface structured for insertion into a thermal spray gun and a water coolable surface coating applied onto at least a portion of the exterior surface. The water coolable surface coating is structured to protect the exterior surface from a chemical interaction with cooling water guided through the thermal spray gun.

21 Claims, 2 Drawing Sheets

(56) References Cited

U.S. PATENT DOCUMENTS

| | | | | |
|---|---|---|---|---|
| 2002/0134766 | A1 | 9/2002 | Kawachi et al. | |
| 2007/0084834 | A1* | 4/2007 | Hanus | H05H 1/34 219/121.5 |
| 2011/0245357 | A1* | 10/2011 | Sun | C08J 3/095 521/28 |
| 2013/0008708 | A1* | 1/2013 | Burke | H05K 9/009 174/390 |

FOREIGN PATENT DOCUMENTS

| | | |
|---|---|---|
| JP | S61-166987 | 7/1986 |
| JP | S61-214400 | 9/1986 |
| JP | H05-84579 | 4/1993 |
| JP | H-919771 | 1/1997 |
| JP | 2001-170760 | 6/2001 |
| JP | 2001-316865 | 11/2001 |
| JP | 2006-247722 | 9/2006 |
| JP | 2008-157090 | 7/2008 |
| JP | 2011-505492 | 2/2011 |
| JP | 2015-511371 | 4/2015 |
| JP | 2016-514200 | 5/2016 |
| JP | 2016-515161 | 5/2016 |
| WO | 2014/064450 | 5/2014 |
| WO | 2014/120357 | 8/2014 |
| WO | 2014/120358 | 8/2014 |
| WO | 2015/094295 | 6/2015 |

OTHER PUBLICATIONS

Written Opinion of Int'l Searching Auth. in counterpart Int'l. Appln. No. PCT/US2015/064465 (dated Feb. 16, 2016).

China Office Action conducted in counterpart China Appln. No. 201580064712.2 (dated Jan. 2, 2019).

Translation of Japan Office Action conducted in counterpart Japan Appln. No. 2017-528583 (dated Oct. 29, 2019).

* cited by examiner

CORROSION PROTECTION FOR PLASMA GUN NOZZLES AND METHOD OF PROTECTING GUN NOZZLES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE EMBODIMENTS

Plasma guns are used in various applications from thermal spray to plasma generators, e.g., to incinerate dangerous materials. Conventional plasma gun nozzles (anodes) used in thermal spray applications have a limited life. In use, the plasma voltage is maintained in a predefined range for proper operation. However, as the plasma arc is generated by the plasma gun, the bore of the nozzle is exposed to extremely high temperatures (>12,000° K). To prevent melting of the nozzle wall, cooling water is circulated through the plasma gun to the anode and cathode.

During operation of the plasma gun, the circulating cooling water will experience micro-boiling along the surface of the nozzle, which causes formation of bubbles at the water/nozzle inside interface surface. Despite the circulating cooling water, hot regions arise on the nozzle. FIG. 1 illustrates a conventional nozzle with a hot region, derived from a computer model, on an outside of the nozzle. Often the cooling water includes impurities, whereby the combination of the micro-boiling and impurities in the water lead to corrosive attack of the copper. Moreover, even high purity distilled and deionized water will eventually cause corrosion over time. As the copper corrodes, the thermal heat transfer coefficient of the copper changes, which alters the thermal state of the plasma nozzle and, therefore, alters the plasma arc. In this regard, testing has shown this change in thermal state leads to de-stabilization of the plasma arc voltage and this instability promotes arc voltage decay. This instability also results in changes of energy state per unit time, which can alter the process at the instantaneous level be it thermal spray or chemical processing.

At the end of its lifetime of use, corrosion can be found on exterior surfaces of a copper nozzle. As the copper corrodes, the thermal heat transfer coefficient of the copper changes, which alters the thermal state of the plasma nozzle and, therefore, alters the plasma arc. In testing, the inventor has found this change in thermal state leads to de-stabilization of the plasma arc voltage and this instability promotes arc voltage decay. This instability has also been found to result in changes of energy state per unit time, which can alter the process at the instantaneous level be it thermal spray or chemical processing.

SUMMARY OF THE EMBODIMENTS

What is needed is a nozzle designed or constructed to reduce or eliminate the corrosion of the copper nozzle at the water interfaces in order to promote arc voltage stability and increase usable hardware life.

Embodiments of the invention are directed to a nozzle for a thermal spray gun that includes a nozzle body having a central bore and an exterior surface structured for insertion into a thermal spray gun and a water coolable surface coating applied onto at least a portion of the exterior surface. The water coolable surface coating is structured to protect the exterior surface from a chemical interaction with cooling water guided through the thermal spray gun.

According to embodiments, the nozzle body can be copper. The nozzle can also include a liner arranged on at least a part of an interior surface of the central bore. Further, the water coolable surface coating may include nickel, chromium, cadmium, vanadium, platinum, gold, silver, tungsten, or molybdenum.

In accordance with other embodiments, the water coolable surface coating can prevent corrosion due to micro-boiling of the cooling water at the water coolable surface.

In embodiments, the water coolable surface coating may have a coating thickness of at least about 0.0001". In other embodiments, the water coolable surface coating can have a coating thickness of between about 0.0005" and about 0.001".

In still other embodiments, the water coolable surface coating can have a coating thickness to avoid limiting heat flow from the nozzle body to the cooling water.

Moreover, the water coolable surface coating can be formed from a material applicable by one of chemical bath deposition, chemical vapor deposition, physical vapor deposition, plasma spray physical vapor deposition, electron discharge physical vapor deposition, or any variants or hybrids thereof.

According to other embodiments, the at least a portion of the exterior surface can include a surface at which a surface temperature of the water cooled surface is expected to approach or exceed a local boiling temperature of the cooling water.

In further embodiments, the at least a portion of the exterior surface may include an entirety of the exterior surface contactable by the cooling water.

Embodiments of the invention are directed to a thermal spray gun that includes an insertable nozzle having a nozzle body with a central bore and an exterior surface, a coating applied to at least portions of the exterior surface, and a water cooling system structured and arranged to guide cooling water onto the at least portions of the exterior surface. The coating is structured to protect the exterior surface from a chemical interaction with cooling water.

According to embodiments, the nozzle body may include copper. In other embodiments, the nozzle can further include a liner arranged on at least a part of an interior surface of the central bore. Further, the water coolable surface coating may include nickel, chromium, cadmium, vanadium, platinum, gold, silver, tungsten, or molybdenum.

In accordance with embodiments, the coating may be formed by a material to prevent corrosion due to micro-boiling of the cooling water at the at least portions of the exterior surface.

In other embodiments, the coating can have a thickness of at least about 0.0001". In further embodiments, the coating can have a thickness of between about 0.0005" and about 0.001".

Embodiments of the invention are directed to a method of forming a nozzle for a thermal spray gun includes coating at least portions of an exterior surface of a nozzle body with at least one of nickel, chromium, cadmium, vanadium, platinum, gold, silver, tungsten, or molybdenum.

In accordance with still yet other embodiments, the coating can be applied by one of chemical bath deposition, chemical vapor deposition, physical vapor deposition, plasma spray physical vapor deposition, electron discharge physical vapor deposition, or any variants or hybrids thereof.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
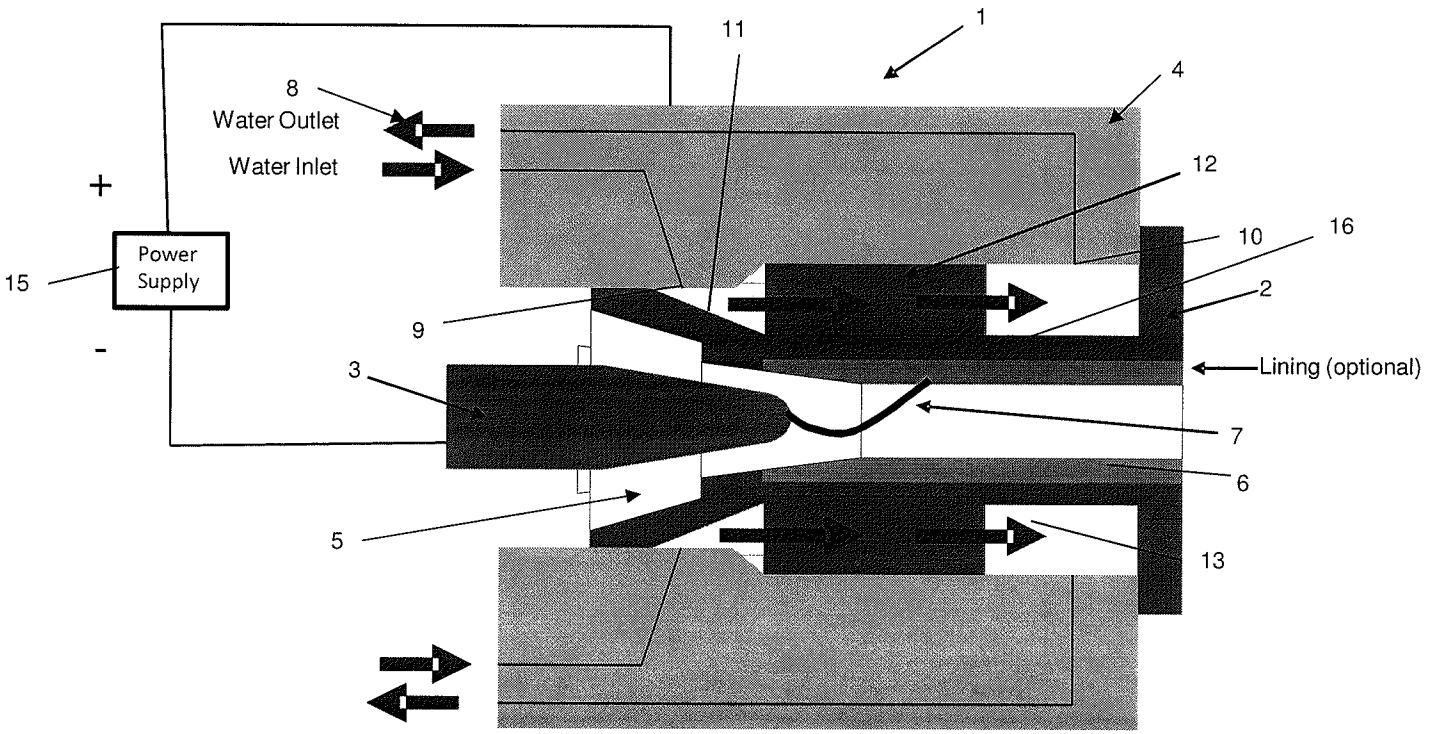
FIG. 1 illustrates a conventional thermal spray gun.

FIG. 1 illustrates a front gun body 1 of a conventional plasma spray gun that includes a conventional plasma nozzle 2, a cathode 3 and a water cooling system 4. The conventional plasma spray gun can be, e.g., an F4MB-XL or 9MB plasma gun manufactured by Oerlikon Metco (US) Inc. of Westbury, N.Y., an SG100 plasma gun manufactured by Progressive Technologies, or any typical conventional plasma gun exemplified by having a single cathode and a non-cascading anode/plasma arc channel. Plasma nozzle 2 can be made of a material with high heat transfer characteristics, e.g., from copper only or a copper nozzle can include a lining, e.g. a tungsten lining, a molybdenum lining, a high Tungsten alloy lining, a silver lining or an iridium lining, to improve performance. A plasma is formed in plasma nozzle 2 by passing a current through a gas, typically, e.g., Ar, $N_2$, He, or $H_2$ and mixtures thereof, creating a plasma arc 7. To create the current, cathode 3 is connected to the negative side of a dc power source (not shown) and nozzle 2, acting as an anode, is connected to the positive side of the dc power source. Plasma nozzle 2 includes a conical bore 5 in which cathode 3 is accommodated and a cylindrical bore 6 in which plasma arc 7 preferably attaches.

In initial operation, plasma arc 7 may travel some distance down cylindrical bore 6 before attaching to the nozzle wall, which produces the highest plasma voltage. By way of non-limiting example, the initial attachment point for plasma arc 7 can be between the first one-third and one-half of cylindrical bore 6 downstream of conical bore 5, and the plasma voltage at the wall is preferably greater than 70 V at predetermined operating parameters. Other parameters will result in different voltages depending upon gasses, hardware geometry, current, etc. As the surface of nozzle wall 2 wears and deteriorates, plasma arc 7 becomes attracted further upstream until plasma arc 7 eventually attaches to the wall of conical bore 5, at which time the voltage drop is large enough to require nozzle 2 to be replaced. The wall within conical bore 5 is an undesired area of plasma arc attachment, where the plasma voltage is less than 70 V at a given operating parameter. Again, other parameters will result in different voltages depending upon gasses, hardware geometry, current, etc.

To cool the nozzle, radially extending from an outer peripheral surface of nozzle 2 is a plurality of fins 12. Fins 12 also extend in a longitudinal direction of nozzle 2 to surround a point at which conical bore 5 and cylindrical bore 6 meet, as well as portions of conical bore 5, e.g., to surround about one-half of a length of conical bore 5, and cylindrical portion 6, e.g., to surround the arc attachment region. When a tungsten lining is provided, fins 12 can be arranged to extend, e.g., from a beginning of the lining forming a portion of the wall in conical bore 5 to an end of predetermined arc attachment region surrounding cylindrical bore 6.

In operation, extremely high temperatures can be produced within bore 6 of nozzle 2, e.g., greater than 12,000° K, which can result in extremely high peak average wall temperatures, e.g., 700-800° K in nozzle bore 6. To prevent the extreme temperatures from melting nozzle 2, water cooling system 4 is arranged to cool the exterior of nozzle 2 with circulating water. Water cooling system 4 includes a water cooling path 8 that enters from a rear of the gun body, is directed around the outer perimeter of nozzle 2 and through cooling fins 12 before exiting. In the illustrated embodiment, water cooling system 4 has at least one water inlet port 9 to supply cooling water from a supply to the outer periphery of nozzle 2 and has at least one water outlet port 10 through which the water cooling the outer periphery of nozzle 2 exits and is returned to the supply. Water inlet port 9 supplies cooling water to contact an outer peripheral surface 11 of nozzle 2 surrounding a part of conical bore 5. The cooling water is then guided through fins 12 to contact and cool the periphery in which fins 12 are located and then into an area to contact and cool the peripheral surface 13 surrounding a part of cylindrical bore 6. It is also understood that the circulating cooling water can be guided through the water cooling path 8 in an opposite direction, or other suitable manners of conveying the cooling water to the surfaces of the nozzle 2 to be cooled can be employed.

Figure 2:
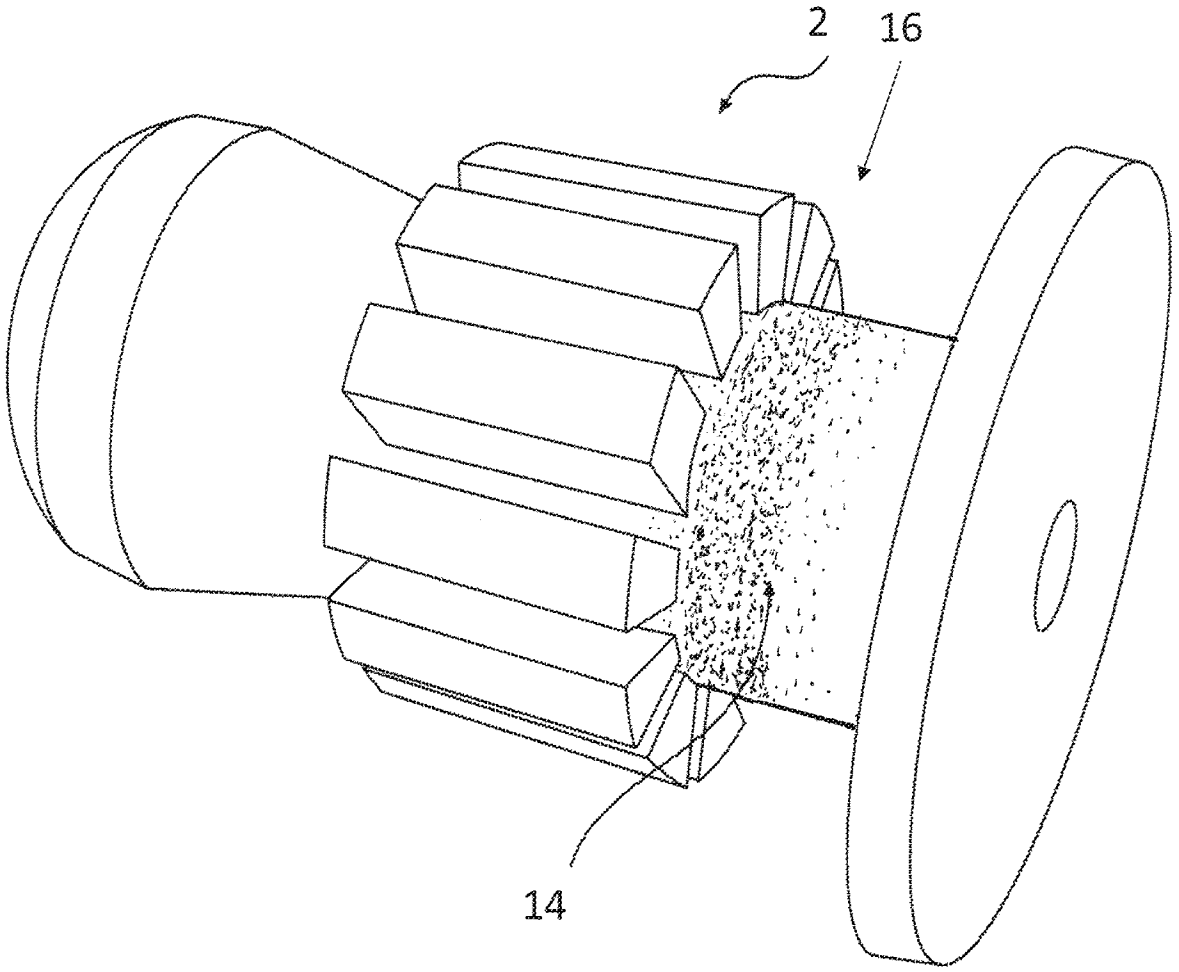
FIG. 2 illustrates a nozzle for the thermal spray gun depicted in FIG. 1 with a boiling pattern.

During operation of the thermal spray gun, the circulating cooling water in water cooling system 4 is under pressure. Consequently, a phenomenon known as micro-boiling can occur along a surface of nozzle 2 as tiny steam bubbles begin forming at the outer peripheral surface of nozzle 2 contacting the cooling water, e.g., outer peripheral surface 11, the outer peripheral surface between fins 12 and outer peripheral surface 16 surrounding part of cylindrical bore 6. FIG. 2 depicts a boiling pattern 14 on outer peripheral surface 16 of nozzle 2 due to micro-boiling. Moreover, it has been found that the micro-boiling of the cooling water on the surface of nozzle 2 in the region of boiling pattern 14 in combination with impurities in the cooling water can lead to a corrosive attack of the exposed nozzle material, e.g., copper, in the region of boiling pattern 14. This is because the steam resulting from the micro-boiling is highly reactive so that any contaminants in the cooling water will attack the copper nozzle material. It has further been found that, even if the cooling water is a high purity distilled and deionized cooling water, corrosion will still eventually occur on the water cooled surface of nozzle 2 because all contaminants cannot be removed from the water and the ultra-pure water itself will naturally attack the copper directly.

As the water cooled material surface, e.g., copper, in the region of boiling pattern 14 corrodes, the thermal heat transfer coefficient of the material changes, thereby altering the thermal state of the nozzle 2. Consequently, the plasma arc will likewise be altered due to this corrosion. More particularly, testing has shown the altered thermal state of nozzle 2 can lead to de-stabilization of the plasma arc voltage and this instability can promote arc voltage decay. This instability can also result in changes of energy state per unit time, which can thereby alter the process at the instantaneous level, be it thermal spray or chemical processing.

While copper is a preferred material in constructing plasma gun nozzles because of its high thermal conductivity and its high electrical conductivity, alternative materials have been tested to construct the entire nozzle 2 with varying results, i.e., from adequate performance to failure resulting in a complete melting of the nozzle. The best alternative material found is tungsten, but even this material is best suited only as a lining of the bore of a copper plasma nozzle bore. Other high melting temperature materials, such as Tungsten alloy or Molybdenum, as described in International Application No. PCT/US2013/0076631 also best suited as a lining rather than for an entire nozzle. Moreover, the use of lining materials other than copper works best when the lining conforms to a thin layer in accordance with International Application No. PCT/US2013/0076610.

In embodiments, surfaces of nozzle 2, and preferably all surfaces of nozzle 2, that are to be exposed to the cooling water are plated to protect the copper material from chemical interaction with the cooling water. It can be particularly advantageous to plate surfaces of nozzle 2 where a surface temperature of the water cooled surface approaches or exceeds a local boiling temperature of the cooling water. Of course it is also advantageous to plate other exterior surfaces of nozzle 2. However, the bore of nozzle 2 where the plasma arc resides should preferably not be plated, as the temperatures generated within this bore would melt the plating material and, consequently, the melted plating material would be ejected from the nozzle.

By way of non-limiting example, the plating can be applied to nozzle 2 by, e.g., chemical bath deposition (electrolysis), chemical vapor deposition (CVD), physical vapor deposition (PVD), plasma spray physical vapor deposition (PSPVD), electron discharge physical vapor deposition (EDPVD), or any variants or hybrids of CVD, PVD, PSPVD, or EDPVD. In particular, as it is the easiest, most common and least costly method, the chemical bath deposition or electrolysis is the preferred plating method. Of course, any method that can apply a sufficiently thin layer of a corrosion resistant pure metal or metallic alloy is viable.

The plating material for providing the desired corrosion protection can preferably be a pure metal, e.g., nickel, chromium, cadmium, vanadium, platinum, gold, silver, tungsten, and molybdenum. Due to its low cost, ease of application and common availability, nickel is the preferred plating material. Moreover, metal alloys that are corrosion resistant can also be considered as a plating material. However, as metal alloys have a considerably lower thermal conductivity than the above-mentioned pure metals, it is to be understood that a plating thickness for a protective layer formed by such metal alloys should be thin enough to avoid limiting heat flow. Further, inert ceramic coatings are generally not considered viable solutions as a plating material because the thermal resistance typically associated with these ceramics is essentially the same as that of the by-products of the corroding copper.

According to embodiments, the plating merely needs to be thick enough to afford protection of the water cooled surface from corrosive attack for a reasonable amount of time. By way of non-limiting example, a plating thickness of at least 0.0001" (2.54 μm) nickel is acceptable to protect the nozzle material, but a somewhat thicker plating thickness may be preferred. In this regard, as long as the plating does not interfere with the tolerance and fit of the nozzle inside the thermal spray gun, a thicker plating thickness can be applied onto the nozzle. Of course, as the plating material has a lower thermal conductivity than the copper in the nozzle, as the plating thickness increases, heat transfer properties of the plated nozzle will decrease, which can result in thermal damage to the nozzle bore. Therefore, by way of further non-limiting example, a plating thickness of about 0.001" (25.4 μm) nickel may be preferable, and a coating thickness of about 0.0005" (12.7 μm) nickel may be most preferred. Moreover, as the other noted pure metals have lower thermal conductivity than nickel, plating thicknesses for these other pure metals would be preferably thinner than the noted nickel plating thicknesses.

In accordance with embodiments, a test article was fabricated by taking a standard thermal spray plasma gun nozzle, e.g., a nozzle corresponding in construction to nozzle 2, and plating a roughly 0.001" thick layer of nickel using electrolysis. In particular, the nickel plating is applied to the exterior surface only, as plating or coating the interior of the nozzle bore has been found to be detrimental to nozzle performance. The plated nozzle was assembled into an F4 plasma gun manufactured by Oerlikon Metco (US) Inc., Westbury, N.Y. and operated for a total of 30 hours, i.e., until the end of hardware life was reached based on a 3 volt drop. The system used contained water quality typical for operating plasma guns. An inspection of the plated nozzle at the end of hardware life found only some very minor affects from chemical precipitate forming in the areas of microboiling, which when wiped off revealed the original unaltered and shiny nickel coated surface.

A second nozzle with identical plating was similarly tested for 30 hours with similar results. In this test the water was replaced with fresh clean distilled and deionized water with a conductivity of less than 1 micro siemens (μS). In this case, there was observed a very thin layer of copper on the nozzle water channels with no precipitate buildup from microboiling. The copper was assumed a result of copper ions being removed from other copper bearing surfaces inside the gun by the water and plating onto the nickel. The addition of this thin copper layer would not impair heat flow as it is too thin even if it underwent oxidation to block heat transfer to the water to any significant level.

Moreover, an inspection of a standard (unplated) nozzle, which was operated for 30 hours at the same operating conditions as the two tested plated nozzle, finds darkening of the copper in areas where the nozzle is subjected to the highest temperatures at the water interface. In these regions, the copper is reacting with dissolved oxygen in the water to form copper oxide, which inhibits heat flow from the nozzle to the water. Conversely, visual inspection of the tested plated nozzle reveals little discoloration, and the discoloration that was found was determined to be from a small buildup of precipitate due to water impurity in the region of micro-boiling and not corrosion.

Moreover, in operation, the plated nozzles exhibited better voltage stability during the entire time of the test as compared to the standard, i.e., unplated, nozzle while also able to resist an eventual decay in average voltage. Thus, the plating of the nozzle results in a nozzle that will last longer and provide more stable plasma arc performance for the life of the nozzle.

It is understood that, while different conventional plasma spray guns may utilize nozzles having dimensions differing from those described in the pending disclosure, it is understood that, without departing from the spirit and scope of the described embodiments for plating the exterior of the nozzle against corrosion, the dimensions of the nozzles can be changed or modified from those identified in the above disclosure.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and sprit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A nozzle for a thermal spray gun comprising:

a nozzle body having a central bore and an exterior surface; and a coating applied at least to the portion of the exterior surface, wherein the coating comprises a corrosion resistant material; and wherein the at least a portion of the exterior surface comprises radially extending fins that laterally extend over at least a part of the central bore.

2. The nozzle according to claim 1, wherein the nozzle body is copper.

3. The nozzle according to claim 2, further comprising a liner arranged on at least a part of an interior surface of the central bore.

4. The nozzle according to claim 2, wherein the coating comprises nickel, chromium, cadmium, vanadium, platinum, gold, silver, tungsten, or molybdenum.

5. The nozzle according to claim 1, wherein the coating prevents corrosion due to micro-boiling of cooling water.

6. The nozzle according to claim 1, wherein the coating has a coating thickness of at least about 0.0001".

7. The nozzle according to claim 6, wherein the coating thickness of between about 0.0005" and about 0.001".

8. The nozzle according to claim 1, wherein the coating has a coating thickness that avoids limiting heat flow from the nozzle body.

9. The nozzle according to claim 1, wherein the coating is formed from a material applicable by one of chemical bath deposition, chemical vapor deposition (CVD), physical vapor deposition (PVD), plasma spray physical vapor deposition (PSPVD), electron discharge physical vapor deposition (EDPVD), or any variants or hybrids of CVD, PVD, PSPVD, or EDPVD.

10. The nozzle according to claim 1, wherein the at least a portion of the exterior surface comprises a surface at which a surface temperature of the coating is expected to approach or exceed a local boiling temperature of cooling water.

11. The nozzle according to claim 1, wherein the at least a portion of the exterior surface comprises an entirety of the exterior surface to be water cooled.

12. A thermal spray gun comprising:

an insertable nozzle having a nozzle body with a central bore and an exterior surface; and at least portions of the exterior surface are coated with a coating comprising a corrosion resistant material, wherein the coated at least portions of the exterior surface are protected from a chemical interaction with steam from a micro-boiling of the cooling water guided through the thermal spray gun; and wherein the at least a portion of the exterior surface comprises radially extending fins that laterally extend over at least a part of the central bore.

13. The thermal spray gun according to claim 12, wherein the nozzle body comprises copper.

14. The thermal spray gun according to claim 13, the nozzle further comprising a liner arranged on at least a part of an interior surface of the central bore.

15. The thermal spray gun according to claim 12, wherein the coating comprises nickel, chromium, cadmium, vanadium, platinum, gold, silver, tungsten, or molybdenum.

16. The thermal spray gun according to claim 12, wherein the coating is formed by a material to prevent corrosion due to micro-boiling of the cooling water at the at least portions of the exterior surface.

17. The thermal spray gun according to claim 12, wherein the coating has a thickness of at least about 0.0001".

18. The thermal spray gun according to claim 17, wherein the thickness of the coating is between about 0.0005" and about 0.001".

19. A method of forming the nozzle according to claim 1 for the thermal spray gun, the method comprising:

coating the at least a portion of the exterior surface of a nozzle body with at least one of nickel, chromium, cadmium, vanadium, platinum, gold, silver, tungsten, or molybdenum.

20. The method according to claim 19, wherein the coating is applied by one of chemical bath deposition, (CVD), physical vapor deposition (PVD), plasma spray physical vapor deposition (PSPVD), electron discharge physical vapor deposition (EDPVD), or any variants or hybrids of CVD, PVD, PSPVD, or EDPVD.

21. The thermal spray gun according to claim 12, further comprising:

water cooling channels of a water cooling system structured and arranged to guide the cooling water onto the at least portions of the exterior surface.

* * * * *